United States Patent [19]

Schiffer

[11] Patent Number: 4,733,476

[45] Date of Patent: Mar. 29, 1988

[54] APPARATUS FOR HORIZONTAL SCORING OF A CEMENTITIOUS WALL

[76] Inventor: Henry Schiffer, 21835 Elbosque Way, Boca Raton, Fla. 33433

[21] Appl. No.: 31,755

[22] Filed: Mar. 30, 1987

[51] Int. Cl.[4] ..... B05C 11/02

[52] U.S. Cl. ..... 33/406; 33/518; 118/102

[58] Field of Search ..... 33/404, 406, 411, 518; 52/105, 749; 118/102

[56] References Cited

U.S. PATENT DOCUMENTS

| | | | |
|---|---|---|---|
| 966,801 | 8/1910 | Daisley | 33/406 |
| 1,941,404 | 12/1933 | Lansing | 33/518 X |
| 2,641,846 | 6/1953 | Zeno | 33/406 |

FOREIGN PATENT DOCUMENTS

| | | | |
|---|---|---|---|
| 506646 | 3/1953 | Belgium | 33/404 |

*Primary Examiner*—Evan K. Lawrence

*Attorney, Agent, or Firm*—Joseph Zallen

[57] ABSTRACT

A synthetic brick wall facing on an existing wall is made by applying to the degreased wall an aqueous acrylic resin emulsion which when dry is then coated with an aqueous creamy mixture of portand cement, lime and perlite. Horizontal scoring of the cementitious wall surface to simulate bricks is accomplished by nailing to the wall two vertical guides having slots, inserting a straight member into selected slots and scoring horizontally along the upper edge of the straight member. The vertical guide comprises two sections of identical construction which nest in one another and are detachably connected by a bolt extending through pre-formed holes.

2 Claims, 10 Drawing Figures

APPARATUS FOR HORIZONTAL SCORING OF A CEMENTITIOUS WALL

FIELD OF THE INVENTION

This invention relates to apparatus for the making of a synthetic brick wall facing on an existing wall using particular materials.

SUMMARY OF INVENTION

The present invention is an apparatus for obtaining horizontal scoring lines in making a synthetic brick wall facing on an existing wall. Making the facing comprises applying to the degreased wall an aqueous acrylic resin emulsion which when dry is then coated with an aqueous creamy mixture of portland cement, lime and perlite.

Horizontal scoring of the cemetitious wall surface to simulate bricks is accomplished by nailing to the wall two vertical guides of the apparatus which have slots. A straight member which can inserted into selected slots allows horizontal scoring along the upper edge of the member.

DETAILED DESCRIPTION

Making the simulated brick wall facing on an existing wall comprises the steps of first making sure that the wall is free of oil and grease. It is recommended that the surface be thoroughly cleaned with a water pressure cleaner and chlorine water, as for example, three parts of water and one part of chlorine bleach. A coating of aqueous acrylic resin emulsion is then applied to the degreased wall. The emulsion can be applied with a brush or roller and preferably contains about 35% solids.

After the acrylic coating has dried, which takes a minimum of about thirty minutes, an aqueous creamy cementitious mixture is then applied with a trowel or the like to a thickness of approximately three eighths to one-half inch. The cementitious mixture comprises portland cement, lime and perlite. The cementitious coating takes approximately two to four hours to set up or dry.

After the cementitious coating has set up sufficiently, horizontal scoring and vertical scoring are made in the surface to simulate bricks. Colored simulated brick is obtained by mixing paint with portland cement, silica and pigment which is applied with a sponge without touching the grout lines. Grout may be applied as desired to the scoring lines.

A preferred way of obtaining the horizontal scoring lines in a rapid and accurate manner is to use an apparatus comprising two vertical guides of substantially identical construction. Each guide has an array of vertically-spaced slots. A straight member such as a so-called two-by-four hardwood plank of desired length is inserted into the selected slots to form a horizontal guide. Scoring is then accomplished by moving a scoring knife along the upper edge of the straight member. This is repeated at various heights to rapidly obtain parallel horizontal scoring lines. The vertical guides are preferably made in two nesting, overlapping sections, as for example, two five foot sections with preformed bolt holes which can form desired lengths from four to ten feet. This would enable the extended vertical guide to abut both the floor and the ceiling in almost any room in a house so as to give a firm position for support of the horizontal straight members.

The preferred formula for the cementitious perlite mixture is that there be equal amounts of portland cement and lime. A preferred proportion of perlite is that of twenty parts of perlite by weight for each one hundred parts of portland cement.

Perlite, is a species saliceous volcanic glass which contains a small amount of compound water. When rapidly heated the water volatalizes causing the perlite to expand into lightweight cellular particles. The term perlite as used in this invention is intended to refer to expanded dehydrated perlite.

A typical creamy cementitious mixture comprises one hundred pounds of portland cement, one hundred pounds of lime and twenty pounds of perlite, to be mixed with approximately twelve gallons of water.

Figure 2:
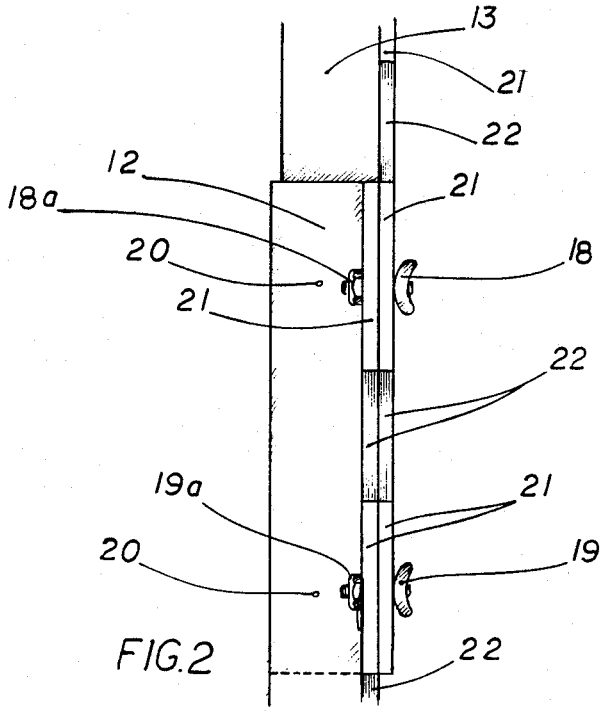
FIG. 2 is an enlarged view of the middle right hand portion of FIG. 1.
Figure 1:
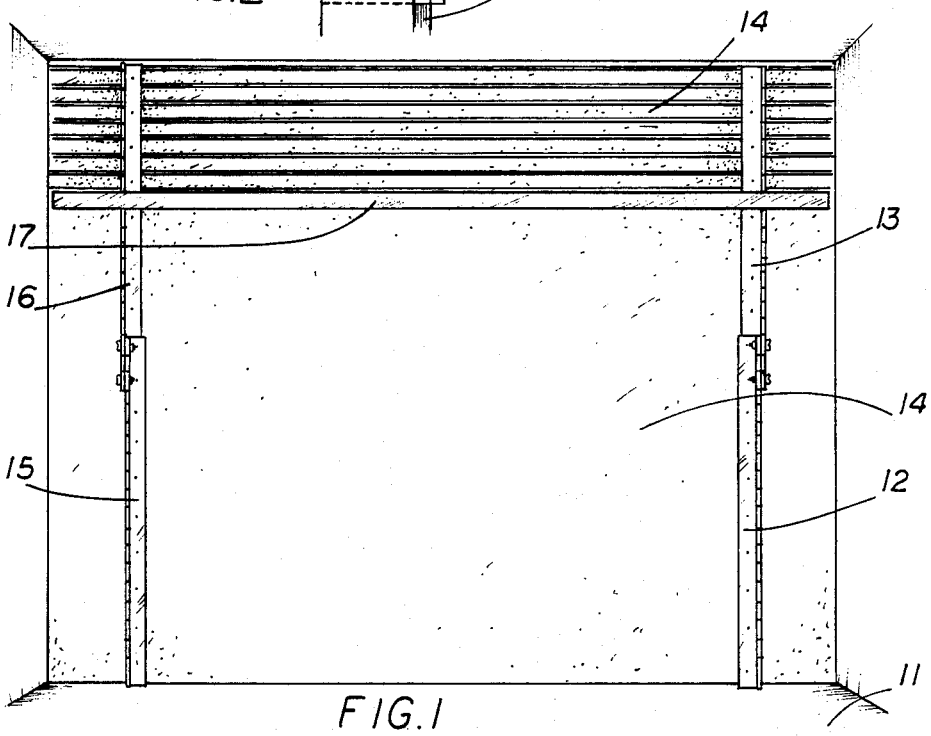
FIG. 1 is an overall view of a wall which has been coated with the resin emulsion and cementitious mixture of this invention, with a pair of vertical standards holding a straight member for horizontal scoring.
Figure 3:
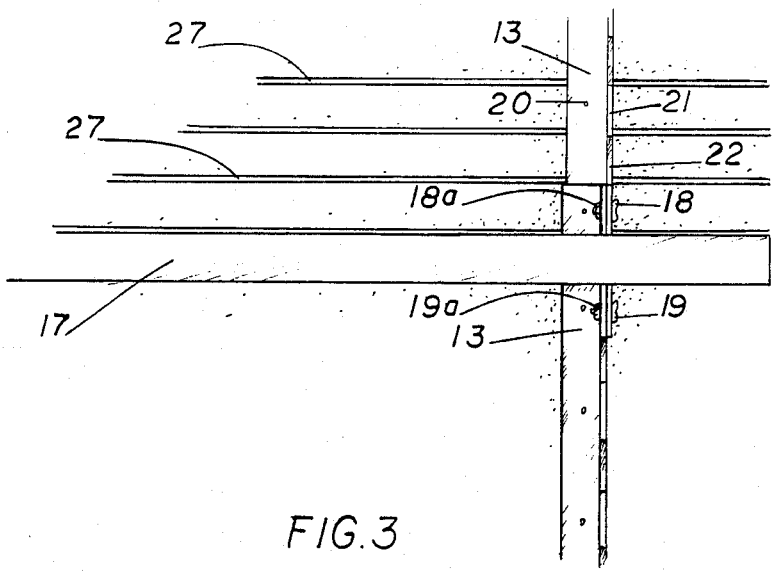
FIG. 3 is an enlarged portion of the middle upper portion of FIG. 1.
Figure 4:
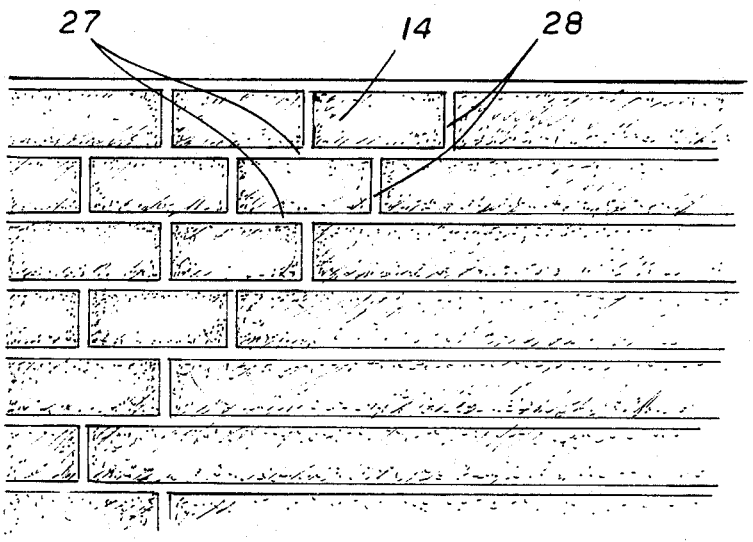
FIG. 4 is a partial view of the treated wall with horizontal scoring and some vertical scoring.
Figure 5:
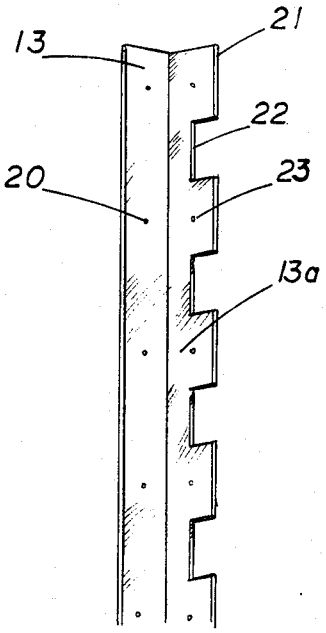
FIG. 5 is a perspective view of the upper portion of a vertical standard made in accordance with this invention.
Figure 6:
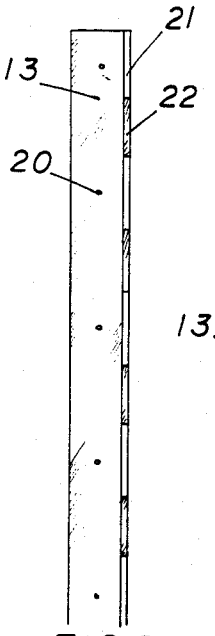
FIG. 6 is a back view of FIG. 5.
Figure 7:
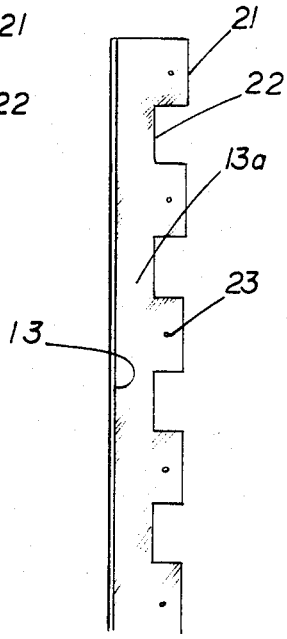
FIG. 7 is a side view of FIG. 5.
Figure 8:
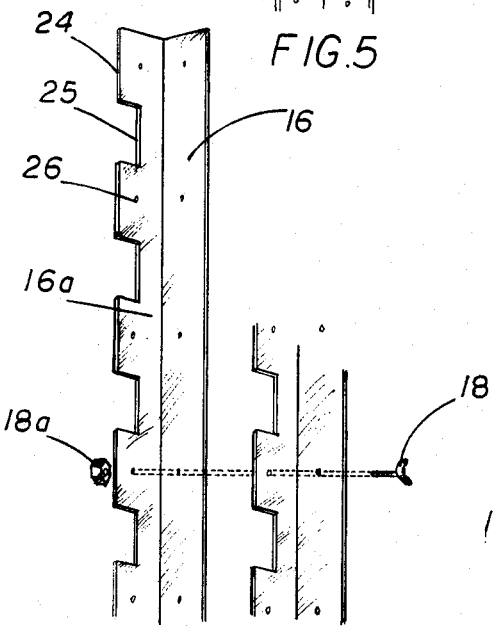
FIG. 8 is a partial exploded view showing how the upper and lower portions of a vertical standard are attached to one another.
Figure 9:
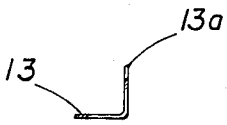
FIG. 9 is a top view of FIG. 5.
Figure 10:
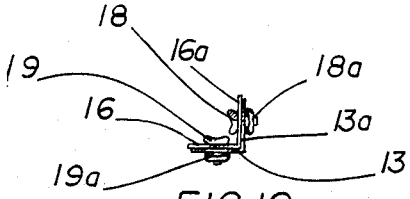
FIG. 10 is a top view of vertical standard 12 and 13.

Referring now to the drawings, vertical guides 12–13 and 15–16 extend from the floor 11 to the ceiling of a room along a wall 14 which has been coated with a cementitious coating in accordance with this invention. A straight member 17 is shown supported horizontally by a notch 22 in guide portion 13 and a notch 25 in guide portion 16. As shown in FIG. 1, the straight member is moved from the top notches downward as horizontal scoring lines 27 are formed. The vertical scoring lines 28 are formed later by hand.

Vertical guide 12–13 comprises a lower angle 12 and upper angle 13. Each angle has nail holes 20 for attaching one portion to the wall, the other portion **13*a* being perpendicular with a plurality of notches 22 alternating with projections 21. Angle 12 nests in angle 13 and is attached to it with bolts 18, 19 and nuts 18*a*, 19*a*** extending through preformed holes.

I claim:

1. An apparatus for horizontal scoring of the surface of a cementitious wall comprising a straight member and at least two vertical guides, and each guide comprising a flat portion having a plurality of spaced predrilled nail holes for attachment of the guide to the wall of and an outwardly extending portion having a plurality of spaced slots for supporting said straight member in a horizontal position for use in horizontal scoring.

2. The apparatus of claim 1 wherein a said vertical guide comprises two sections of identical construction which nest in one another and are detachably connected by a bolt extending through preformed holes in a said outwardly extending portion.

* * * * *